United States Patent [19]

De Paolis et al.

[11] Patent Number: 4,636,694

[45] Date of Patent: Jan. 13, 1987

[54] PROCESS AND APPARATUS FOR THE RAPID ADJUSTMENT OF THE STATIC CONVERGENCE AND PURITY IN A TELEVISION TUBE, BY USING A PERMANENT MAGNET

[75] Inventors: Cesare De Paolis, Rome; Guiseppe Giannantonio, Anagni; Claude Pons, Rome, all of Italy

[73] Assignee: Videocolor, Montrouge, France

[21] Appl. No.: 792,247

[22] Filed: Oct. 30, 1985

Related U.S. Application Data

[63] Continuation of Ser. No. 603,025, Apr. 23, 1984.

[30] Foreign Application Priority Data

Apr. 26, 1983 [FR] France ..... 83 06833

[51] Int. Cl.[4] ..... H01J 29/70; H01J 29/76

[52] U.S. Cl. ..... 315/368

[58] Field of Search ..... 315/368, 370; 358/10

[56] References Cited

U.S. PATENT DOCUMENTS 4,211,960 7/1980 Barten et al. .

4,220,897 9/1980 Barten et al. ..... 315/368

FOREIGN PATENT DOCUMENTS 37766 3/1981 European Pat. Off. .

2907898 9/1980 Fed. Rep. of Germany .

2001803 7/1978 United Kingdom .

OTHER PUBLICATIONS

Patent Abstracts of Japan, vol. 6, No. 37, Mar. 6, 1982, p. 915 E 97.

*Primary Examiner*—Theodore M. Blum

*Attorney, Agent, or Firm*—Pollock, VandeSande & Priddy

[57] ABSTRACT

Process for adjusting the static convergence and/or purity of a color television tube by using a magnetic ring surrounding the neck of the tube and coils creating in this ring induction poles of values selected to carry out the adjustment. To the terminals of each coil a current impulse is applied conferring on the remanent induction an important value higher than that necessary to carry out the correction; then a current impulse is applied in the opposite direction effecting a partial demagnetization in such a way that the remanent induction allows the desired adjustment.

7 Claims, 4 Drawing Figures

PROCESS AND APPARATUS FOR THE RAPID ADJUSTMENT OF THE STATIC CONVERGENCE AND PURITY IN A TELEVISION TUBE, BY USING A PERMANENT MAGNET

This application is a continuation of application Ser. No. 603,025 filed Apr. 23, 1984.

BACKGROUND OF THE INVENTION

Field of the Invention

The present invention concerns a process and an apparatus for conferring on a magnet the induction necessary to carry out adjustment of the static convergence and/or of the purity in a color television tube.

SUMMARY OF THE PRIOR ART

It is known that the reproduction of television images is obtained by the displacement of a luminous dot on the screen of a tube along lines from left to right and from top to bottom. At each instant, the intensity and the color of the luminous dot correspond to the intensity and the color of the corresponding dot of the image to be reproduced. With this purpose, the screen is covered by luminescent materials intended to emit, when they are hit by a beam of electrons, a light of determined color; the screen is thus covered by three types of luminescent materials, each type emitting a primary color. It is formed of triads of primary colors, generally red, green and blue; each of the triads corresponds to one dot to be reproduced, the eye reconstituting one color from the three elements constituting this triad. Inside the tube are located three electron guns, one for each color. Each gun produces an electron beam only reaching the luminescent particles of the corresponding color; with this purpose, the beams produced by these three guns have different directions and a perforated mask or shadow mask is disposed in front of the screen inside the tube. It is thus the relative position of the perforations, of the triads on the screen and of the directions of the electron beams that allows to obtain the desired aim, namely that each gun only hits the luminescent particles of a determined color.

The scanning, i.e. the displacement of the luminous dot on the screen, is obtained due to a variable magnetic field produced by coils called deflector coils or deflectors supplied with variable intensity current.

In order to obtain a faithful reproduction of the outlines (without colored fringes) of the images, it is necessary that the three electron beams converge in order to form a single virtual luminous spot (since it is hidden by the mask) on the screen. This result is obtained by an adjustment, called convergence adjustment, during manufacture of the tube.

It will be easily understood that the three electron beams must have precise positions with respect to the screen; the gun affected by one color must only reach the luminescent particles parts producing this color. In the contrary case, the colors are not "pure". With this purpose, an adjustment called purity adjustment is carried out during manufacture of the tube.

The adjustments that cause the scanning to intervene, i.e. the deflectors, are called dynamic adjustments. They consist in positioning in a precise manner the deflectors with respect to the remainder of the tube.

The adjustments not using scanning are called static adjustments. The static convergence and purity adjustments are of this type. They are carried out either by displacement of the magnets, or by modulation of the induction of the poles of a magnetizable ring disposed about the neck of the cathodic tube. In other words, in this latter case, poles of magnets are produced of which each has an induction and a position such that they carry out the adjustment of the static convergence and purity.

Up until now, in order to carry out this adjustment the magnet or magnets were demagnetized through the use of an alternate current of continually decreasing amplitude then the magnet was remagnetized until the remanent induction value allowing the static adjustment was reacted. It has also been proposed (British Pat. No. 2001803) to magnetize the magnet then to demagnetize it in a progressive manner.

In the known processes, the demagnetization is an operation the duration of which is of several seconds per operation and which consumes energy.

The present invention allows a considerable reduction of the adjustment duration as well as the energy consumed.

This results from the observation, on the one hand, that a complete or practically complete demagnetization, is not indispensable and, on the other hand, that a progressive demagnetization is not indispensable either.

The process according to the invention consists in strongly magnetizing the magnetic material then in decreasing the magnetization and reversing it until induction is reached allowing the adjustment of static convergence and/or purity. To strongly magnetize, it is sufficient to cause a circulate a current of strong intensity in a magnetization coil and to partially demagnetize, to cause to pass a single impulse (thus of short duration) of opposite direction current through this coil.

In one example, the duration of a magnetization/demagnetization current is about 60 milliseconds, which leads to a total duration of operating the process of about a half-second whereas with the classic process—each magnetization/demagnetization cycle (complete or quasi complete) having a duration of about several seconds—the total duration is about one minute. Similarly, when demagnetization occurs progressively the total duration is about one minute. Furthermore, as will be seen hereinbelow, the circuit allowing the magnetization to be carried out according to the invention can be particularly simple.

When the relation between the intensity of the current supplied to the induction coil of the magnet is invariable, for example, when the magnetization coil is in contact, without air-gaps, with the material to be magnetized, a determined intensity of current in the magnetization coil will produce an induction of determined value, i.e. a known magnetization. The result in this case is that the adjustment can easily be carried out automatically; indeed, a prior calibration having allowed to determine the curve of variation of the magnetization to be produced (or the intensity of the current in the magnetization coil) to correct the static convergence and purity errors in function of the value of these errors, the presence of a device—such as a programmed computer—for measuring these errors is foreseen that delivers a signal representing the current intensity to be supplied to the magnetization coil in order to obtain the desired correction.

The adjustment can also be carried out automatically, even if the relation between the current intensity in the magnetization coil and the induction obtained in the magnetic material is not determined, the relative positions of the coil and the magnet being, for example, variable. In this case, a regulation circuit is used; the static convergence and purity errors measured on the screen deliver an input signal to a converter the output signal of which supplies the magnetization coil, the converter being such that the signal supplied tends to reduce the measured errors.

In order to measure the static convergence errors, a device is used for example, as described in French Pat. No. 80 07412 and to measure the purity errors, it is possible to utilize a device of the type such as described in U.S. Pat. No. 4001877.

BRIEF DESCRIPTION OF THE DRAWINGS

Other characteristics and advantages of the invention will appear from reading through the description of certain embodiments, this being made with reference to the annexed figures in which.

SUMMARY OF THE INVENTION

A color television tube 1 comprises a glass shell presenting at its front end a plate 2 the internal face of which presents a layer 3 of cathodo-luminescent substances, alternately green, red and blue and in front of which is located a perforated mask 4.

Figure 1:
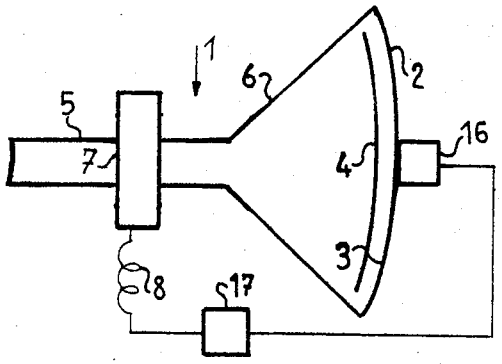
FIG. 1 is a schematic diagram of an apparatus operating the process according to the invention.

The rear of the tube 1 has the form of a cylinder, called neck, inside of which are located the three electron guns (not represented). It is about this neck 5 and the flared part 6 connecting the neck to the plate 2 that is installed the deflector allowing to ensure the scanning. For simplicity sake, this deflector has not been represented on the schematic of FIG. 1.

About the neck 5 is also disposed a permanent magnet in the form of a ring. It is formed of a mixture of plastic material and ferrite called "plastoferrite".

The dispersion of the poles in this ring 7 as well as the magnetization intensity ensure the adjustment of static convergence and purity.

In order to magnetize the ring 7, eight coils 8 are applied against the periphery of this ring and each coil is supplied in such a way that after its removal, the desired adjustment is obtained, i.e. the tube presents neither static convergence defect nor purity defect.

Figure 3:
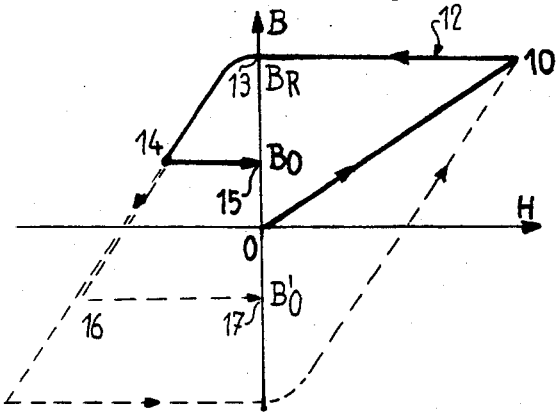
FIGS. 3 and 4 are diagrams illustrating the process according to the invention.
Figure 4:
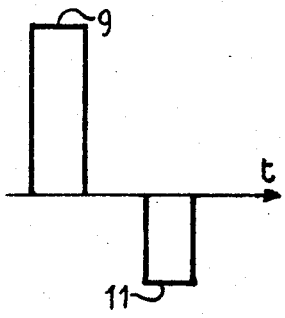

Firstly, is applied to the terminals of each coil 8 a current (or voltage) impulse 9 (FIG. 4) of a determined polarity, which in the magnetization diagram of the ring 7 (FIG. 3), allows to pass from the origin 0 to the point 10 that corresponds to a strong magnetization, i.e. a strong remanent induction $B_R$ (induction in the absence of exciting magnetic field H).

The intensity of the impulse 9 is of a value sufficient that, in every case, the magnetization that it confers, i.e. the value $B_R$ of remanent induction is higher than the magnetization necessary to obtain the adjustment of static convergence and purity.

Under these conditions, to carry out the adjustment, it is thereafter necessary to demagnetize the ring 7. With this purpose, is applied to the terminals of each coil 8 an impulse 11 of an amplitude lower than that of impulse 9 and in the opposite direction. It is thus possible to pass from point 10 of the hysteresis circle 12 (FIG. 3) to the point 13 for which H=0, then to point 14. When the impulse 11 has disappeared, the magnetization state of the ring 7 is represented by the point 15 with a remanent induction $B_0$. In this example, the remanent induction $B_0$ is positive. It can happen that it be necessary to confer to negative remanent induction. In this case an impulse 11 is applied of greater amplitude but always lower than that of the impulse 9 and in the opposite direction. After passing to point 16 and when the impulse 11 has disappeared, point 17 with a remanent induction $B'_0$ is attained.

In order to determine the induction values $B_0$ necessary for obtaining corrections, the static convergence and purity errors are measured by using a device 16 (FIG. 1) disposed against the front face of the plate 2 that supplies a signal to a computer 17 programmed to convert the error signal into a signal representing the amplitude of impulses 11 that must be applied to coils 8 in order to obtain the correction of these errors through the resulting action of all the poles produced in the ring 7.

The program of the computer 17 is established from a prior calibration, i.e. for the control of this program, the relation that exists between the amplitude of the errors and the amplitude of the currents to be injected in the coils 8 in order to obtain the desired correction is determined by measurements.

Instead of a programmed computer 17, a simple converter can also be used.

Figure 2:
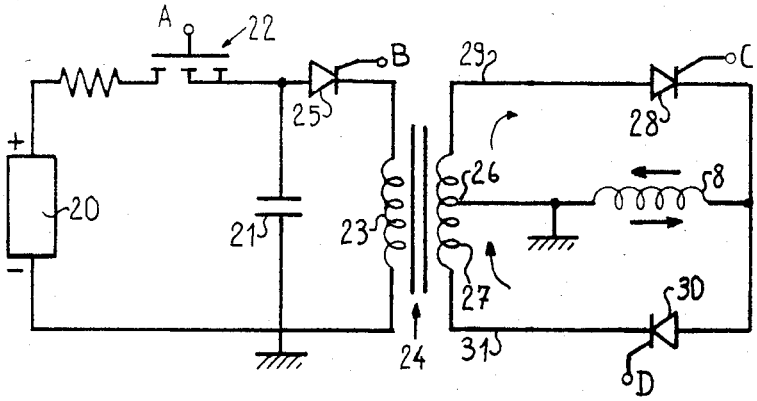
FIG. 2 is a schematic diagram of the electric circuit of the apparatus according to FIG. 1.

FIG. 2 represents a circuit allowing to generate impulses 9 and 11.

A direct voltage supply 20 charges a capacitor 21 through the intermediary of a controlled switch 22 such as a power field effect transistor.

The charge of the capacitor 21 determines the amplitude of the impulse 9 or 11 that will be applied to coil 8. It is therefore the conduction duration of the switch 22 that determines the impulse amplitude.

The discharge circuit of the capacitor 21 comprises, on the one hand, the primary 23 of an impulse transformer 24 and, on the other hand, in series another controlled switch 25 such as a thyristor.

The middle point 26 of the secondary 27 of the transformer 24 is connected to a ground terminal of the coil 8. The second terminal of the coil 8 is connected to the cathode of a thyristor 8 the anode of which is connected to a first end 29 of the secondary 27. This second terminal of the coil 8 is also connected to the anode of another thyristor 30 the cathode of which is connected to the second end 31 of the secondary 27.

Operating is as follows:

When the charge of capacitor 21 has attained the value required—value that is determined by the computer 17 and which corresponds to the intensity of impulse 11 or 9—the switch 22 is on and the switch 25 is off as well as one of the two switches 28 or 30. The switch 28 is off when it is necessary to apply the positive impulse 9 whereas the switch 30 is off when it is necessary to apply the negative impulse 11.

The conduction control of the switches 22, 25, 28 and 30 can be carried out from computer 17.

In the example, where the number of poles to be created in the ring 7 is eight, eight coils 8 are foreseen and to each coil is associated a pair of thyristors 28, 30 whereas the remainder of the circuit is unique. With this purpose, the end 29 is connected to eight anodes of thyristors 28 and the end 31 is connected to eight cathodes of the thyristors 30. The eight poles are thus successively created or modified by using the same circuit. The creation of each pole 8 has an average duration of about 60 milliseconds; the whole of the adjustment therefore lasts about 0.5 second.

The process of the invention presents, other than lasting only a short time, the advantage of requiring only a particularly simple circuit such as that of FIG. 2, whereas with the previously known method, it was necessary to use a relatively complex circuit to carry out the complete demagnetization.

What is claimed is:

1. Process for adjusting the static convergence and purity of a color television tube of the perforated or shadow mask type which comprises the steps of:

applying to the terminals of at least one coil a first single current impulse thus inducing, on a magnetic member surrounding a neck of the tube, remanent induction of a value higher than that necessary to make the adjustment; and further applying a second single current impulse, to the coil terminals, in an opposite direction to reduce the remanent induction of said magnetic member, whereby substantially complete demagnetization to a preselected value for the static convergence and purity adjustments is effected.

2. Process according to claim 1 wherein the coil is physically in contact with the periphery of the magnetic member which forms a ring surrounding the neck of the tube.

3. Process according to claim 1 wherein the magnetic member forms a ring surrounding the neck of the tube; and further wherein several coils are displaced relative to one another to form a corresponding number of poles on the ring.

4. Apparatus for adjusting the static convergence and purity of a color television tube of the perforated mask or shadow mask type having a magnetic member surrounding the neck thereof, comprising:

at least one coil inducing on the magnetic member an induction value sufficient to deflect electron beams in the television tube to obtain said adjustment;

means placed in front of the screen of the tube for measuring static convergence and purity errors;

a converter connected to the measuring means for transforming these errors into corresponding current impulses; and control means working cooperatively with the converter for applying to terminals of the coil a first single current impulse to induce in the magnetic member a remanent induction of a value higher than that which is necessary to make the adjustment, and further applying a second single current impulse of a lower value in the opposite direction to reduce the remanent induction of said magnetic member, whereby substantially complete demagnetization to a preselected value for the static convergence and purity adjustments is effected.

5. Apparatus according to claim 4, wherein the control means comprises:

an impulse generator;

a capacitor to be charged by said impulse generator to a value representing the impulse amplitude which must be applied to the coil for the static convergence and purity adjustments;

an impulse transformer having a primary winding for receiving current discharging from the capacitor;

a coil connected in circuit with the secondary winding of said impulse transformer; and two control switches connected in the circuit with the secondary winding of said impulse transformer, the switches alternately closing so that the discharge current flows in one direction through the coil when the first switch is closed thereby generating the first current impulse and flows in the opposite direction when the second switch is closed thereby generating the second current impulse.

6. Apparatus according to claim 5, wherein the magnetic member is a ring surrounding the neck of the tube, the apparatus further comprising several coils displaced relative to one another to form a corresponding number of poles on the ring, and wherein each coil is connected to a pair of control switches; whereas the remainder of the supply circuit is common, and wherein the poles are formed or modified sequentially.

7. Process according to claim 1, wherein the time separating the beginning of the first single current impulse from the end of the second current impulse is approximately 60 milliseconds.

* * * * *